US007192180B2

(12) United States Patent
Hayek et al.

(10) Patent No.: US 7,192,180 B2
(45) Date of Patent: Mar. 20, 2007

(54) DETENT ESCAPEMENT FOR TIMEPIECE

(75) Inventors: Nicolas Georges Hayek, Meisterschwanden (CH); Thierry Conus, Lengnau (CH); Andres Cabezas Jurin, Yverdon-les-Bains (CH)

(73) Assignee: Montres Breguet S.A., L'Abbaye (CH)

( * ) Notice: Subject to any disclaimer, the term of this patent is extended or adjusted under 35 U.S.C. 154(b) by 287 days.

(21) Appl. No.: 11/000,379

(22) Filed: Dec. 1, 2004

(65) Prior Publication Data

US 2005/0128880 A1 Jun. 16, 2005

(30) Foreign Application Priority Data

Dec. 16, 2003 (EP) ..... 03028877

(51) Int. Cl.
*G04B 15/00* (2006.01)

(52) U.S. Cl. ..... 368/127; 368/124

(58) Field of Classification Search ..... 368/124, 368/125, 126, 127, 128, 129, 130, 131, 132, 368/133

See application file for complete search history.

(56) References Cited

U.S. PATENT DOCUMENTS 3,538,705 A * 11/1970 Perry ..... 368/125
4,122,665 A * 10/1978 Giger ..... 368/327
6,942,378 B2 * 9/2005 Hayek et al. ..... 368/127
7,040,803 B2 * 5/2006 Hayek et al. ..... 368/127

FOREIGN PATENT DOCUMENTS

CH 64 175 D 1/1977

OTHER PUBLICATIONS

European Search Report, completed Jul. 13, 2004.

* cited by examiner

*Primary Examiner*—Vit Miska
*Assistant Examiner*—Sean Kayes
(74) *Attorney, Agent, or Firm*—Griffin & Szipl, P.C.

(57) ABSTRACT

The escapement includes a large plate 4 carrying a first finger 14 and a blocking member 6 carrying a second finger 11 and a locking pallet-stone 7. The first and second fingers 14 and 11 are shaped such that when the large plate 4 rotates in a first direction a, the first finger 14 drives the second 11 which moves around a first side 20 of said first finger to release the locking pallet-stone. Re-engagement occurs when the second finger 11 climbs over a vertical flank 25 of a notch 22 made in a small plate 23. When the large plate 4 rotates in a second direction b, opposite to the first, the first finger 14 drives the second finger 11 which moves around a second side 21, opposite to the first, of said first finger 14 to keep the locking pallet-stone 7 in the escapement wheel.

7 Claims, 9 Drawing Sheets

DETENT ESCAPEMENT FOR TIMEPIECE

This application claims priority from European Patent Application No 03028877.3 filed Dec. 16, 2003, the entire disclosure of which is incorporated herein by reference.

The present invention relates, to a detent escapement for a timepiece, including an escapement wheel, fitted with teeth, a balance on the pin of which there is fixed a large roller fitted with an impulse pallet-stone and a first actuating finger and a small roller on the circular periphery of which a notch is made, and a blocking member in the form of a lever hinged on a pin, said stop member carrying a device for blocking the escapement wheel and a second actuating finger.

A detent escapement broadly answering the above description has already been proposed and disclosed in the old Swiss Patent No. CH-3299 in the name of Emile James. The proposed arrangement shows a detent-lever pivoted at one of its ends in accordance with a conventional construction of this type of escapement. The balance pin carries a large roller, a first small roller carrying a notch and a second small roller carrying an actuating finger. The detent-lever carries a device for blocking the escapement wheel—in this case, a locking pallet-stone—, a pin, a beak and a strip spring. The detent-lever is returned to the rest position by a spiral shaped return spring. At the moment when the actuating finger raises the detent with the assistance of the strip spring, the beak penetrates the notch at the same time that the escapement wheel moves forward by one step. During the additional arc, the beak is released from the notch is in proximity to the circular periphery of the first small roller.

This arrangement has the advantage of preventing a tooth of the wheel from leaving the locking pallet-stone when the timepiece receives a shock. Indeed, at that moment, the beak abuts for a brief moment against the circular periphery of the first small plate, which stops the detent-lever which is immediately returned to the rest position by the spiral shaped return spring.

The foregoing identifies a weakness affecting the detent escapement, namely that it is very sensitive to shocks, thus this escapement is reserved especially for chronometers of large dimensions or marine chronometers that are not mechanically stressed, said escapement having the reputation of not being suited to wristwatches.

It will be noted however, in what is proposed by the aforecited Swiss Patent, that removal of the beak from the notch is only possible owing to the spiral shaped spring, which exerts a return force on the detent-lever. Indeed, the notch carries almost radial sheer flanks preventing any removal of the beak which might be caused simply by rotation of the roller itself.

Another detent escapement partially answering the description of the first paragraph of this text was proposed by Breguet and is the subject of an illustration (Figure 402) in the work by George Daniels entitled "I'Art de Breguet" (London 1975). It concerns a pivoting detent chronometer escapement using a blocking member in the form of a lever hinged on a pin. One arm of the lever is fitted with a locking pallet-stone cooperating with the teeth of the escapement wheel. The other arm cooperates with a spring device mounted on the roller secured to the balance. This spring device is a very short strip able both to actuate the lever when the roller rotates in one direction and to remain without any effect on said lever when the roller rotates in the opposite direction. Therein lies the principle of every detent escapement in which the impulse is only given to the balance once by oscillation during which the escapement wheel rotates through one angular step whereas, in lever escapements, said wheel advances through a half step at each vibration. One of the advantages provided by the detent escapement can be seen here, since the energy wasted following the escapement wheel's inertia only occurs once per oscillation instead of once per vibration.

It was stated hereinbefore that the detent escapement is suitable for timepieces of large dimensions, which use large balances having a large energy reserve and a strong torque for actuating the elastic member that acts on the detent. During a vibration, in fact, the elastic member has to be tightened to release the locking pallet-stone, whereas at the next vibration, the same elastic member has to be let down to enable it to move around the detent which is not being activated.

It is an object of the present invention to propose a timepiece of small dimensions, for example a wristwatch, which is fitted with a detent escapement to replace, for example, the conventional lever escapement and to benefit from the advantages provided by the detent escapement. It will be understood however, that using the prior known techniques described hereinbefore would lead to failure since the energy produced by the balance of a wristwatch is much less than that produced by a marine chronometer, this balance thus proving incapable of overcoming the forces acting on the detent.

Thus the detent escapement of the present invention is characterised in that it omits the elastic member acting on the detent. For this purpose, the detent escapement according to the invention, in addition to answering the definition of the first paragraph of this description, is characterised in that the first and second actuating fingers are shaped such that when the large and small rollers rotate in a first direction, the first finger drives the second finger which moves around a first side of said first finger to release the escapement wheel locking device, the second finger being then driven by a vertical flank with which the notch of the small roller is provided to re-engage the locking device in the escapement wheel, and such a way that when the large and small rollers rotate in a second direction, opposite to the first direction, the first finger drives the second finger which moves around a second side, opposite to the first, of said first finger to keep the locking device engaged in the escapement wheel.

The invention will be explained in detail hereinafter by several embodiments given by way of example, these embodiments being illustrated by the annexed drawings, in which.

Figure 1:
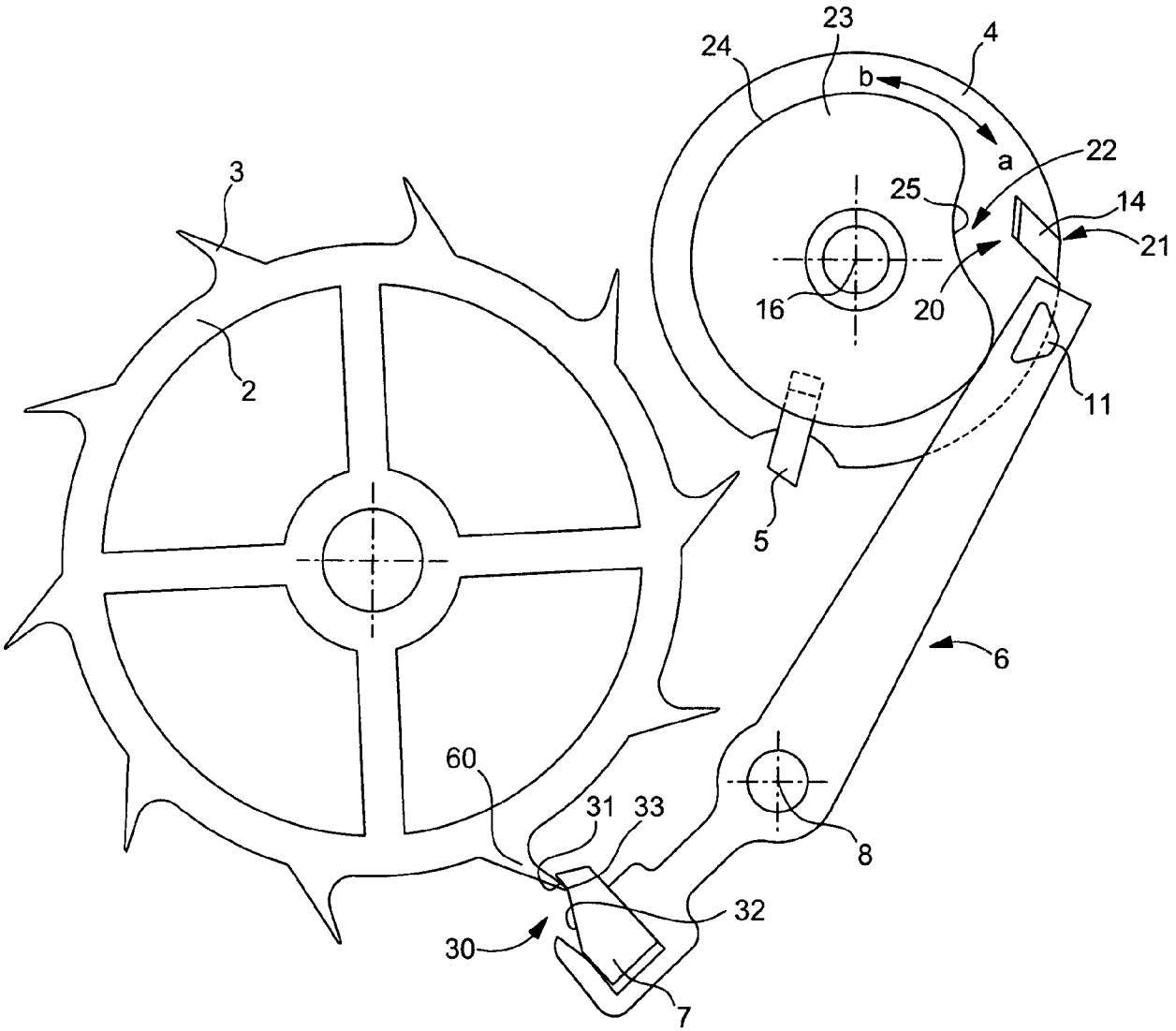
FIG. 1 is a plan view of a first embodiment of the escapement according to the invention.
Figures 2, 3:
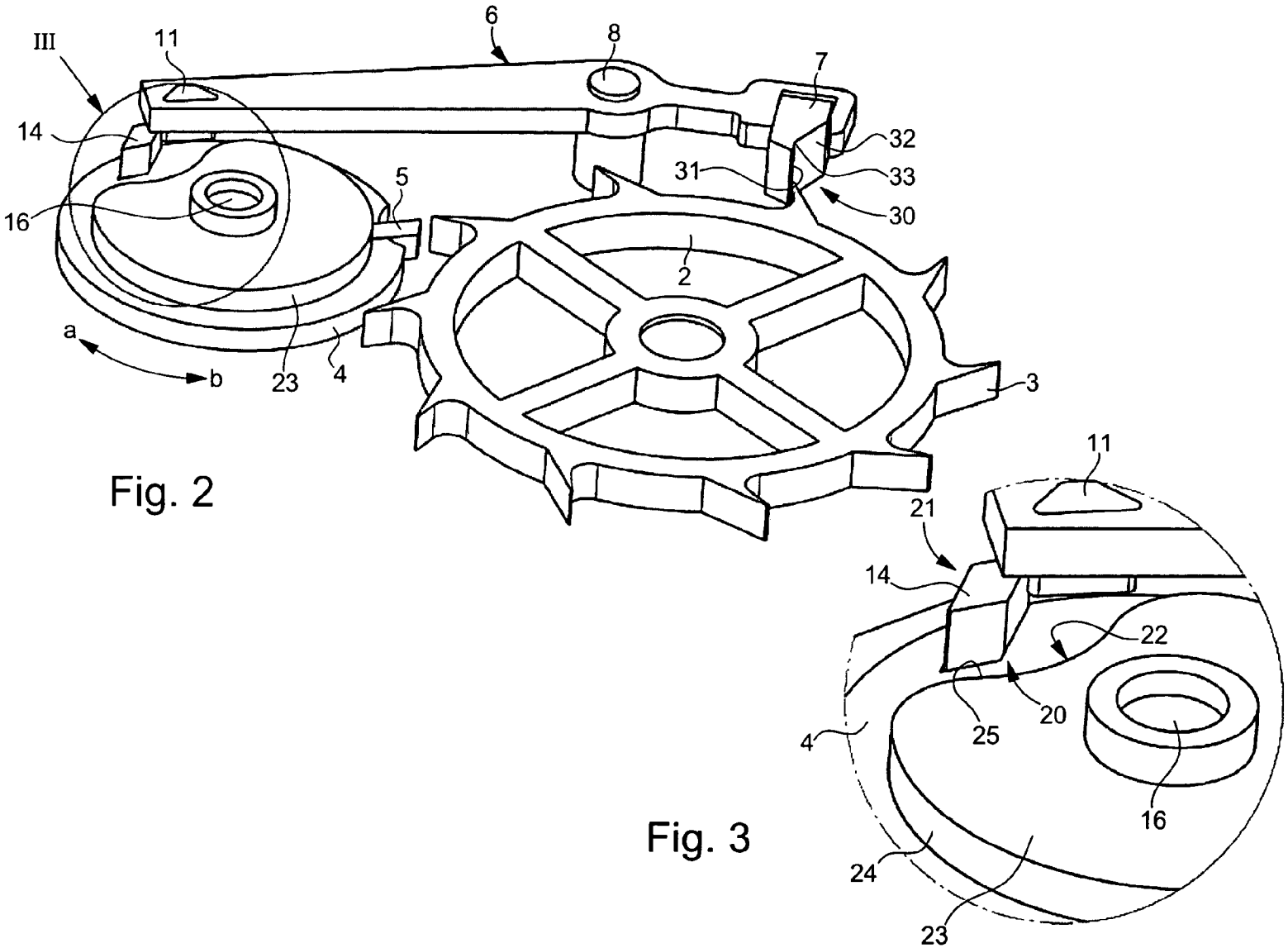
FIG. 2 is a perspective view of the embodiment shown in FIG. 1.
FIG. 3 is an enlargement of zone III of FIG. 2.

FIGS. 1 to 3 illustrate the detent escapement that forms the subject of the present invention according to a first embodiment. The escapement includes an escapement wheel 2 fitted with teeth 3. Although not shown in the drawings, the escapement wheel is driven by the gear train of the timepiece, which receives its driving force from a barrel. On the pin 16 of the balance (not shown) there is fixed a large roller 4 fitted with an impulse pallet-stone 5 and a first actuating finger 14. On the same balance pin 16 there is fixed a small roller 23 having a circular periphery 24 and a notch 22. The Figures also show that the escapement includes a blocking member in the form of a lever 6 hinged on a pin 8. The blocking member 6 carries a locking device or locking pallet-stone 7 and a second actuating finger 11.

As already stated hereinbefore, the detent escapement of the present invention is characterised in that it omits an elastic member acting on the blocking member 6. In order to achieve this result, FIGS. 1 to 3 show a particular configuration of the first and second actuating fingers 14 and 11. Indeed, because of this, when the large and small rollers 4 and 23 rotate in a first direction a, first finger 14 drives second finger 11 moving around a first side 20 of said first finger 14, which has the effect of releasing locking pallet-stone 7 from escapement wheel 2 and initiating an impulse on the balance. Second finger 11 is then driven by a rising flank 25 of notch 22 of small roller 23, which has the effect of re-engaging locking pallet-stone 7 in escapement wheel 2. Likewise, the first and second actuating fingers 14 and 11 are shaped such that, when large and small rollers 4 and 23 rotate in a second direction b, opposite to the first, first finger 14 drives second finger 11 moving around a second side 21, opposite to the first, of said first finger 14, which has the effect of keeping locking pallet-stone 7 engaged in escapement wheel 2.

As recalled hereinbefore, therein lies the principle of the detent escapement in which the impulse is only given to the balance once per oscillation. Indeed it has just been seen that the escapement wheel is released when the rollers rotate in one direction, whereas it remains locked when said rollers rotate in the other direction.

The operation of the detent escapement will now be described in detail with reference to FIGS. 4 to 13, which illustrate different phases of operation.

Figure 4:
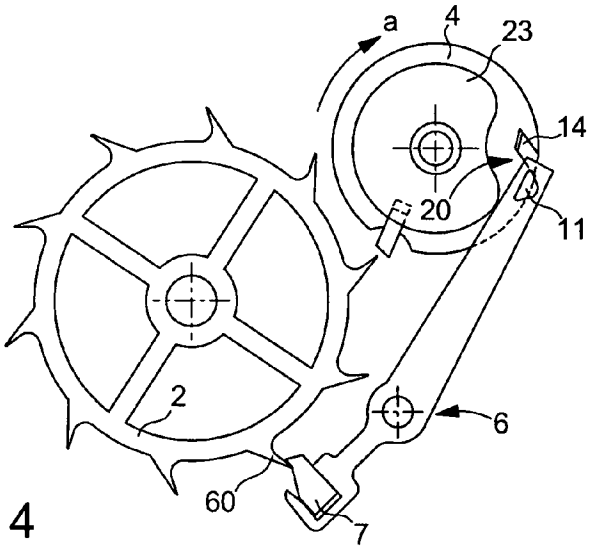

In FIG. 4, rollers 4 and 23 are rotating in the direction arrow a. First finger 14 secured to large roller 4 enters into contact with second finger 11 fitted to blocking member 6. Locking pallet-stone 7 of blocking member 6 is completely engaged in tooth 60 of escapement wheel 2, which is locked.

Figure 5:
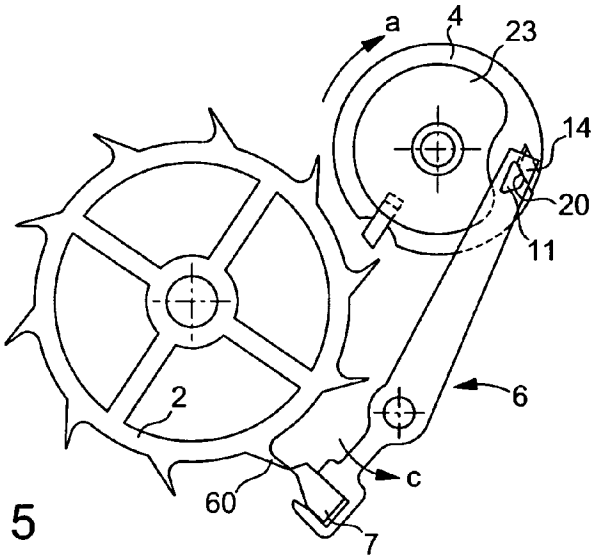
FIGS. 4 to 13 are plan views explaining several operating phases of the escapement of the invention.

In FIG. 5, rollers 4 and 23 continue their travel in the direction of arrow a. Second finger 11 driven by first finger 14 starts to move around a first side 20 of said first finger 14, which causes blocking member 6 to rotate in the direction of arrow c and to release pallet-stone 7 from tooth 60. In FIG. 5, pallet-stone 7 is at the very beginning of said release.

Figure 6:
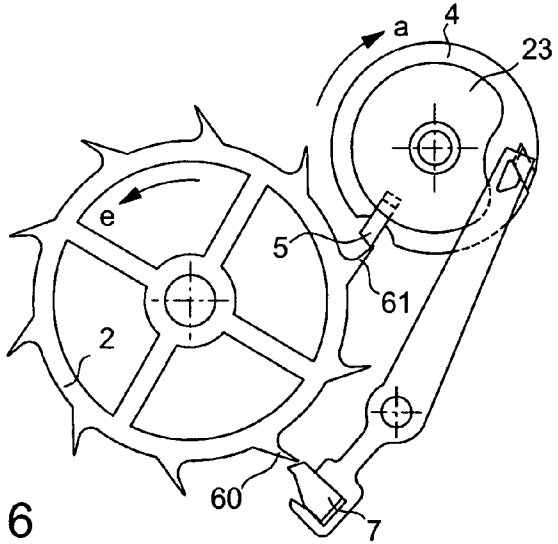

In FIG. 6, escapement wheel 2 is free and rotates in the direction of arrow e. Pallet-stone 7 is completely released from tooth 60 and tooth 61 of wheel 2 enters into contact with impulse pallet-stone 5. This is the beginning of the impulse given to rollers 4 and 23. Wheel 2 continues to rotate in the direction of arrow e.

Figure 7:
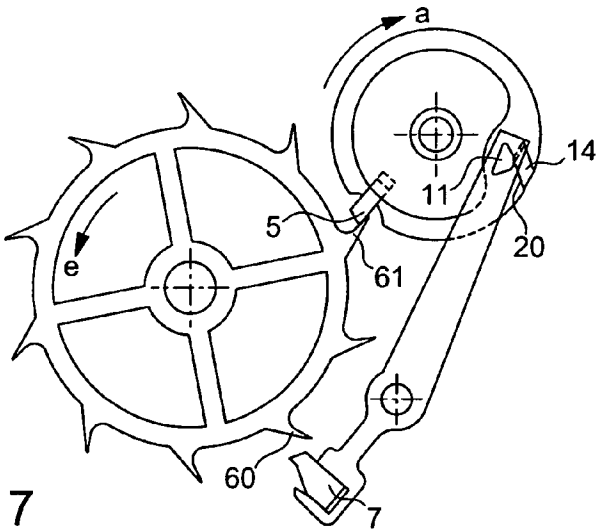

In FIG. 7, the impulse given by tooth 61 to pallet-stone 5 continues to cause rollers 4 and 23 to rotate in the direction of arrow a. Second finger 11 driven by first finger 14 continues to move around side 20 of said first finger 14 along which it slides.

Figure 8:
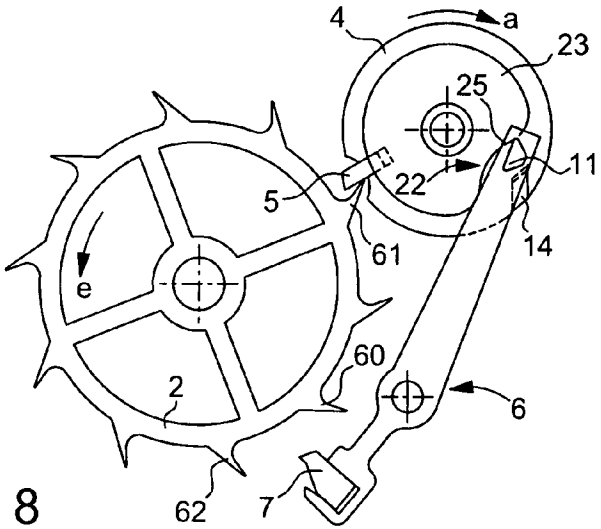

In FIG. 8, wheel 2 is still moving and continues to drive impulse pallet-stone 5. Second finger 11 has passed under first finger 14 and enters into contact with ramp 25 of notch 22 made in second roller 23.

Figure 9:
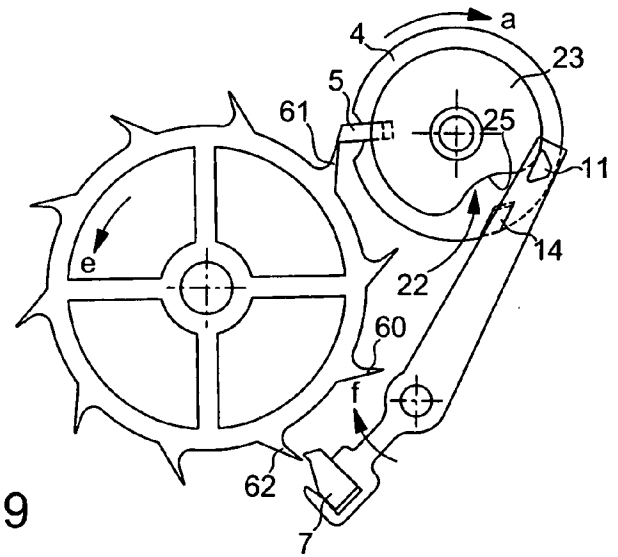

In FIG. 9, tooth 61 of wheel 2 is leaving impulse pallet-stone 5. Second finger 11, driven by roller plate 23 has climbed over flank 25 of notch 22 causing blocking member 6 to rotate in the direction of arrow f and forcing locking pallet-stone 7 to insert itself in the space separating teeth 60 and 62.

Figure 10:
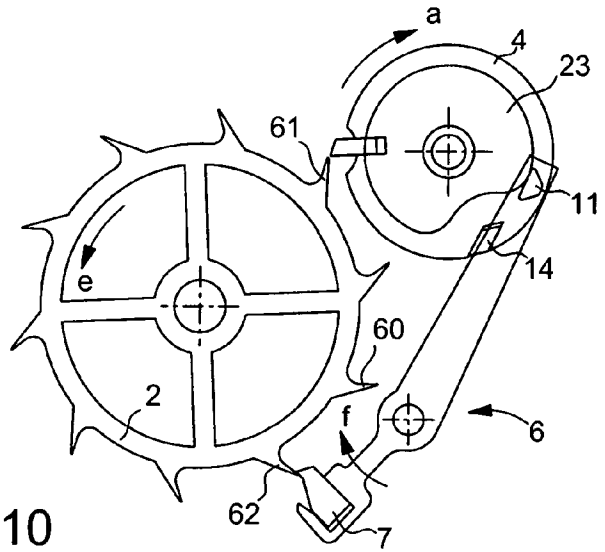

In FIG. 10, tooth 62 has just come into contact with locking pallet-stone 7.

Figure 11:
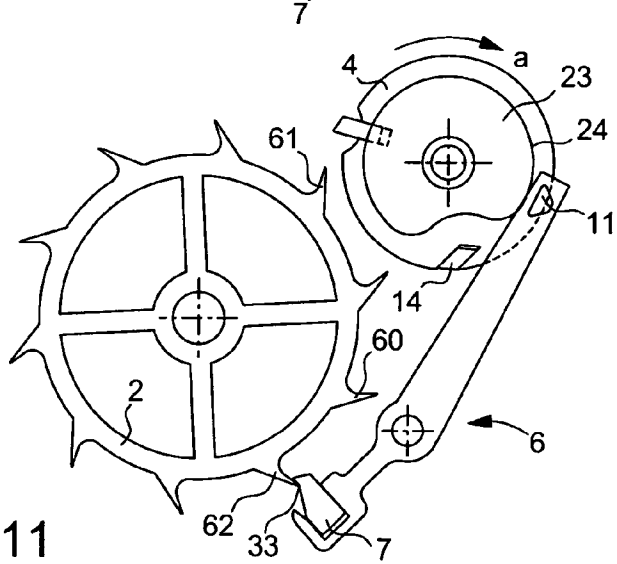

In FIG. 11, it can be seen that the tip of tooth 62, pushed by the kinetic energy of wheel 2, is lodged along a locking line 33 of pallet-stone 7. Indeed, in this first embodiment of the invention, face 30 (see also FIGS. 1 and 2) against which a tooth of wheel 2 abuts, includes a first locking face 31 located in front of pallet-stone 7 and a second locking face 32 located behind it, this second plane being inclined with respect to the first to form a locking line 33. Via the effect of drawing, well known to horologists, the tip of tooth 62 is lodged on locking line 33 and stops there, the second locking face 32 upright in front of it, preventing it from continuing on its way. It will be observed that this device means that a stop pin, generally used to limit the shake of the blocking member, can be omitted.

FIG. 11 also shows that second finger 11 has been lifted off circular periphery 24 of small roller 23, leaving the balance complete freedom to travel through its additional arc in the direction of arrow a. It will be noted that from this moment onwards, the escapement is resistant to any shocks which could affect the timepiece. Indeed, a shock would cause second finger 11 to abut against periphery 24 of small roller 23 without causing pallet-stone 7 to be released, tooth 62 returning to locking line 33 immediately after the shock due to the aforecited drawing.

Figure 12:
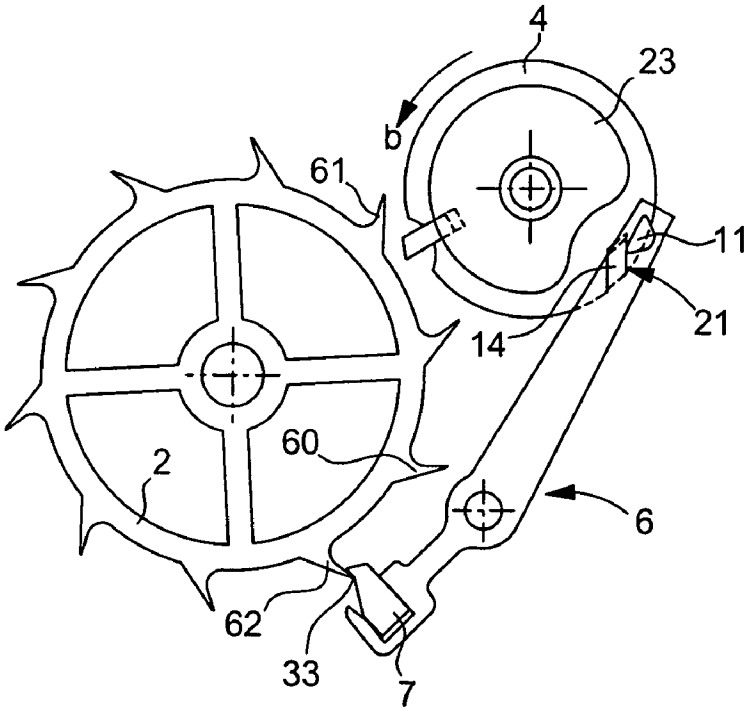

In FIG. 12, the escapement is shown finishing the additional reverse arc (second vibration of the balance). Rollers 4 and 23 are thus rotating in the direction of arrow b. Via its second side 21, first actuating finger 14 enters into contact with second finger 11. Tooth 62 is still immobilised on line 33 of pallet-stone 7.

Figure 13:
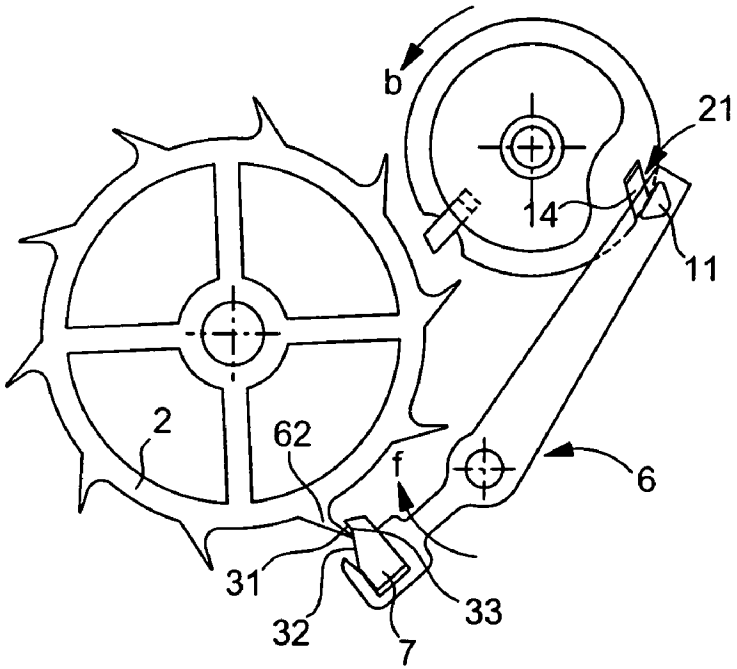

In FIG. 13, rollers 4 and 23 continue their travel in the direction of arrow b. Second finger 11, driven by first finger 14, has moved around second side 21 of said first finger 14, which causes blocking member 6 to rotate in the direction of arrow f. At this moment, the tip of tooth 62 climbs over the second locking face 32 of pallet-stone 7 forcing wheel 2 into a slight backward movement against the drive force that it exerts thereon. When second finger 11 has left first finger 14, tooth 62 will have descended from the second locking face 32 of pallet-stone 7 to be stabilised again on locking line 33. Thus, as already stated hereinbefore, when the large and small rollers 4 and 23 rotate in a second direction b, opposite to the first, first finger 14 drives second finger 11, which moves around a second side 21, opposite to the first side of said finger 14, to keep locking pallet-stone 7 engaged in escapement wheel 7. We are then in the situation of FIG. 4 and a new oscillation can begin.

Figure 14:
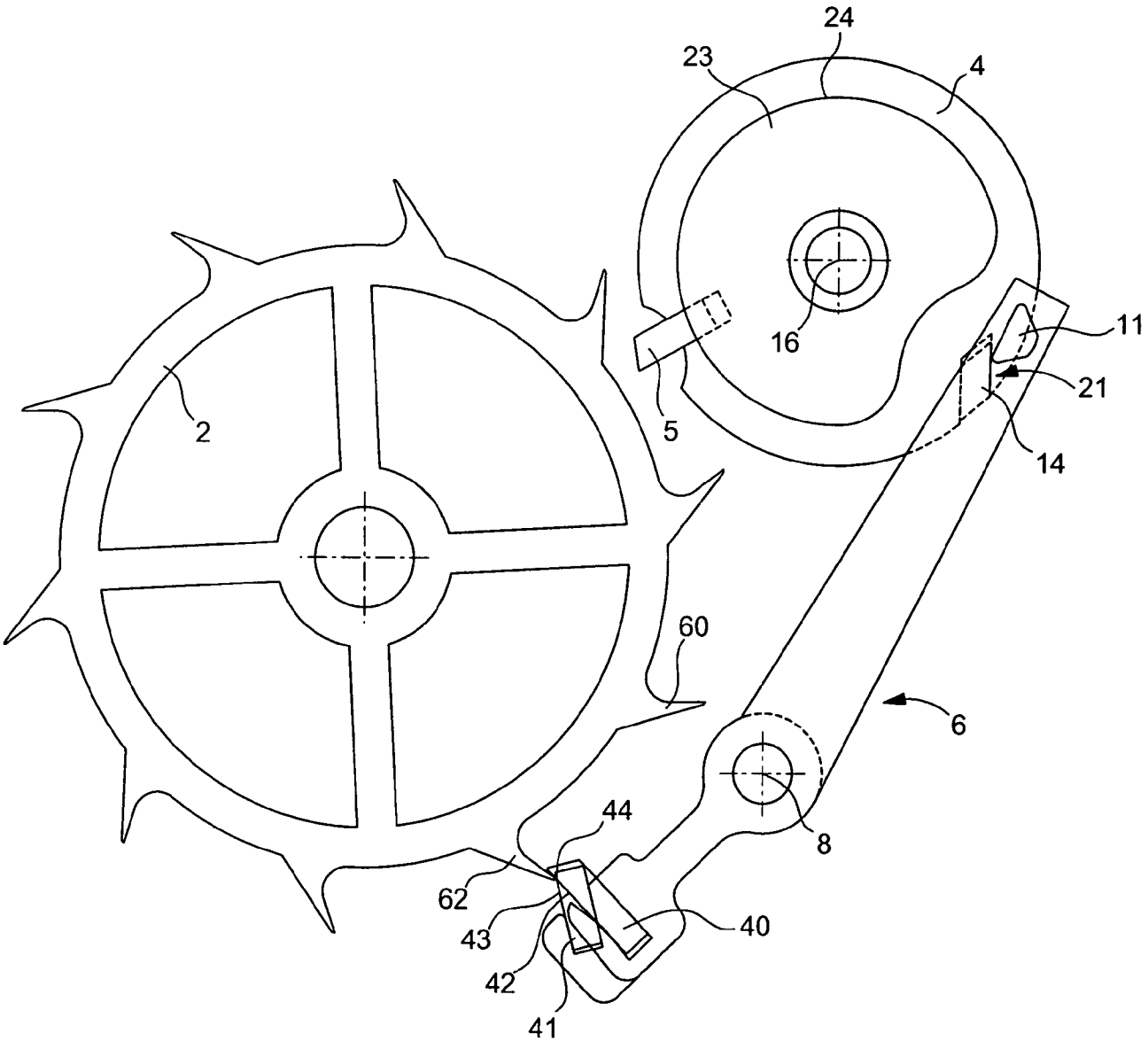
FIG. 14 is a plan view of a second embodiment according to the invention.
Figure 16:
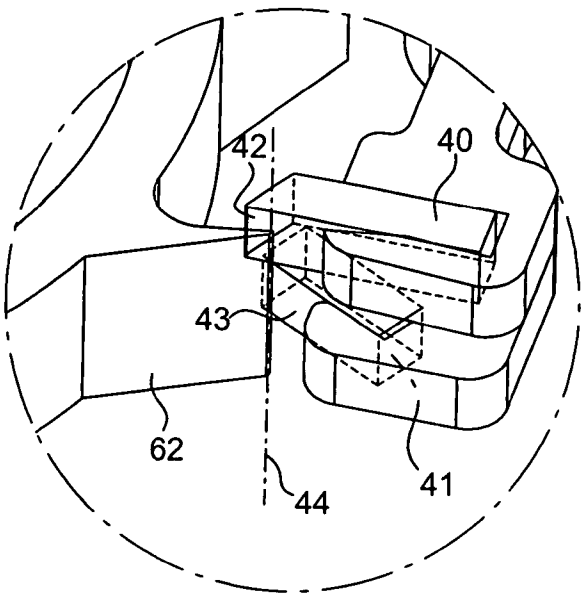
FIG. 16 is an enlargement of zone XVI of FIG. 15.
Figure 15:
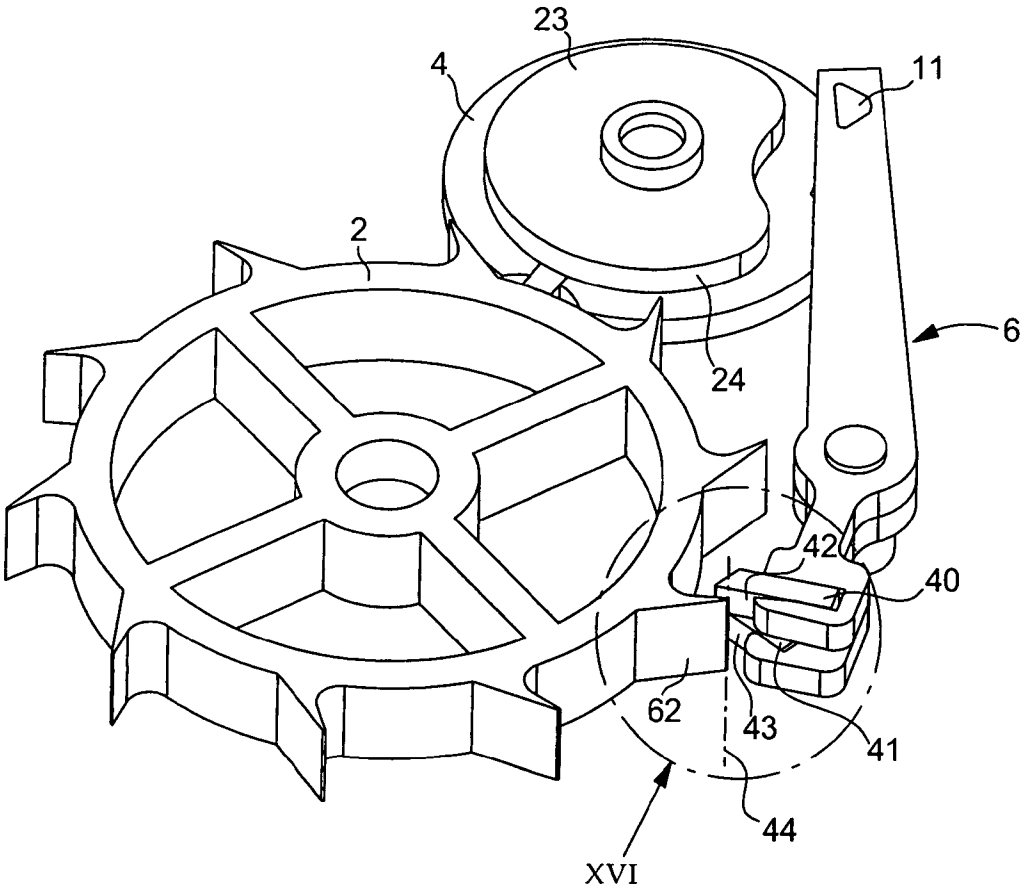
FIG. 15 is a perspective view of the embodiment shown in FIG. 14.

FIGS. 14 to 16 illustrate the detent escapement according to a second embodiment. As can be clearly seen, the single pallet-stone of the preceding embodiment has been replaced by first and second locking pallet-stone-stones 40 and 41 arranged on each other, all the other elements forming the escapement remaining the same. The first and second locking pallet-stones 40 and 41 respectively have first and second locking faces 42 and 43 inclined in relation to each other to form a locking line 44 along which tooth 62 of escapement wheel 2 can rest. The first locking face 42 intercepts tooth 62 of wheel 2 when first pallet-stone 40 is inserted between two teeth 60 and 62. As for the first embodiment, when first finger 14 drives second finger 11, via its second side 21, tooth 62 climbs over the second face 43 of second pallet-stone 41. Tooth 62 returns to locking line 44 when second finger 11 leaves first finger 14.

As regards the rest, the various operating phases remain the same as those explained and illustrated in FIGS. 4 to 13. In particular, the tip of tooth 62 lodges, via the effect of drawing, on locking line 44 and stops there, the second locking face 43 upright in front of it, preventing it from continuing on its way.

Figure 17:
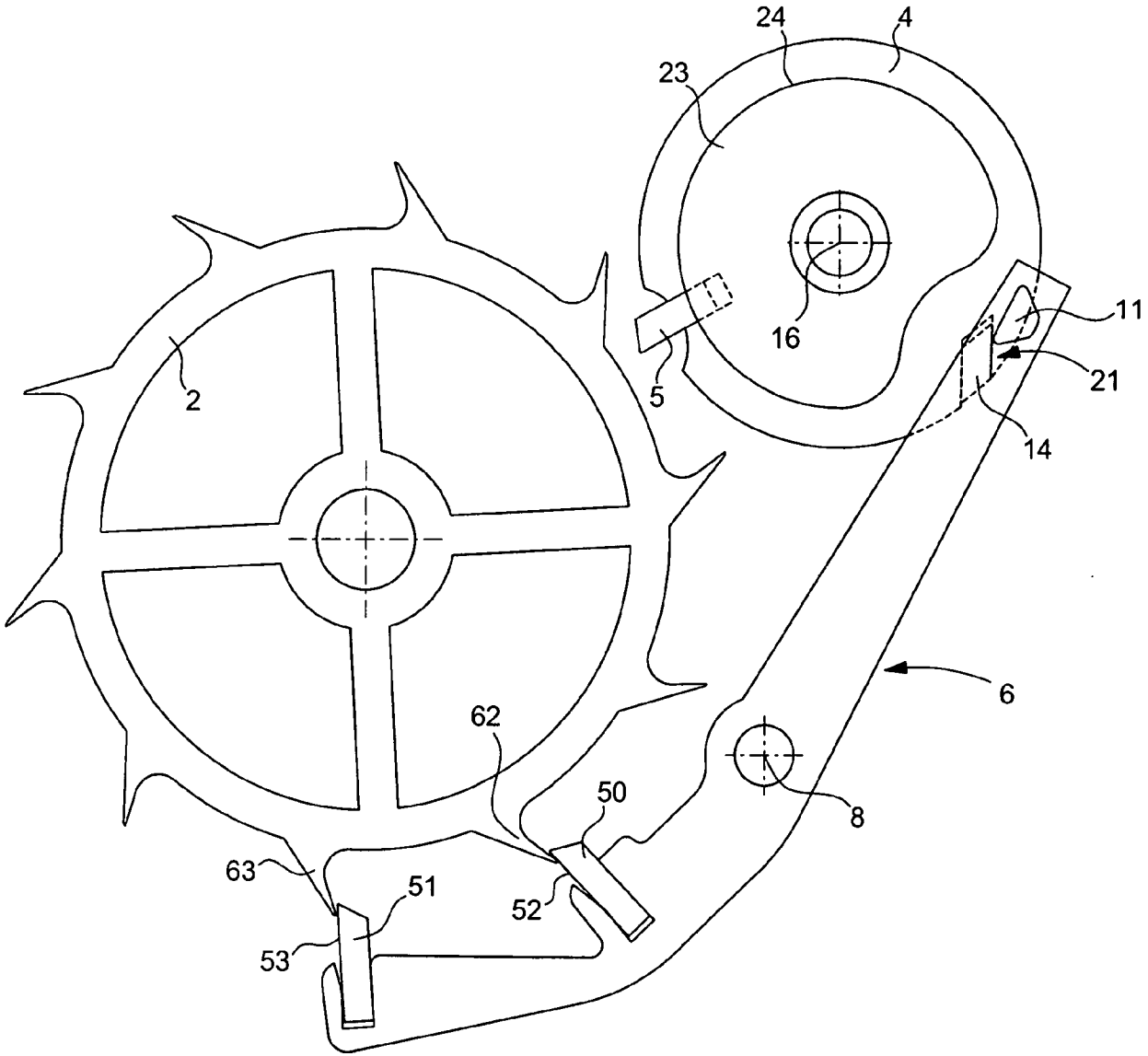
FIG. 17 is a plan view of a third embodiment of the invention.
Figure 19:
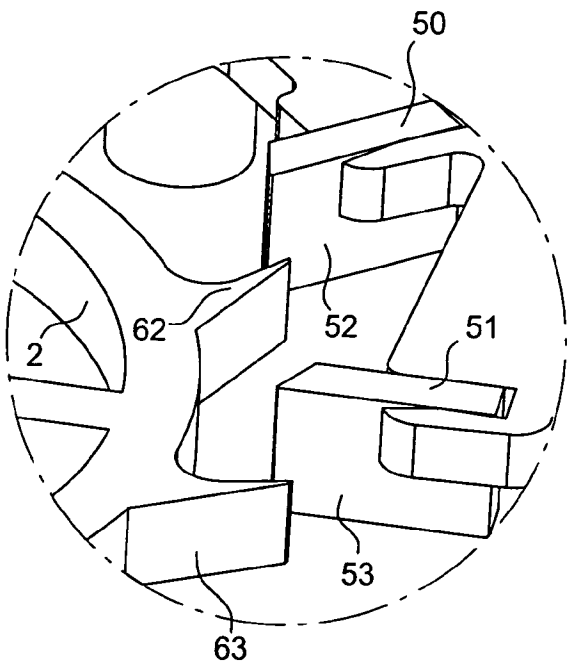
FIG. 19 is an enlargement of zone XIX of FIG. 18.
Figure 18:
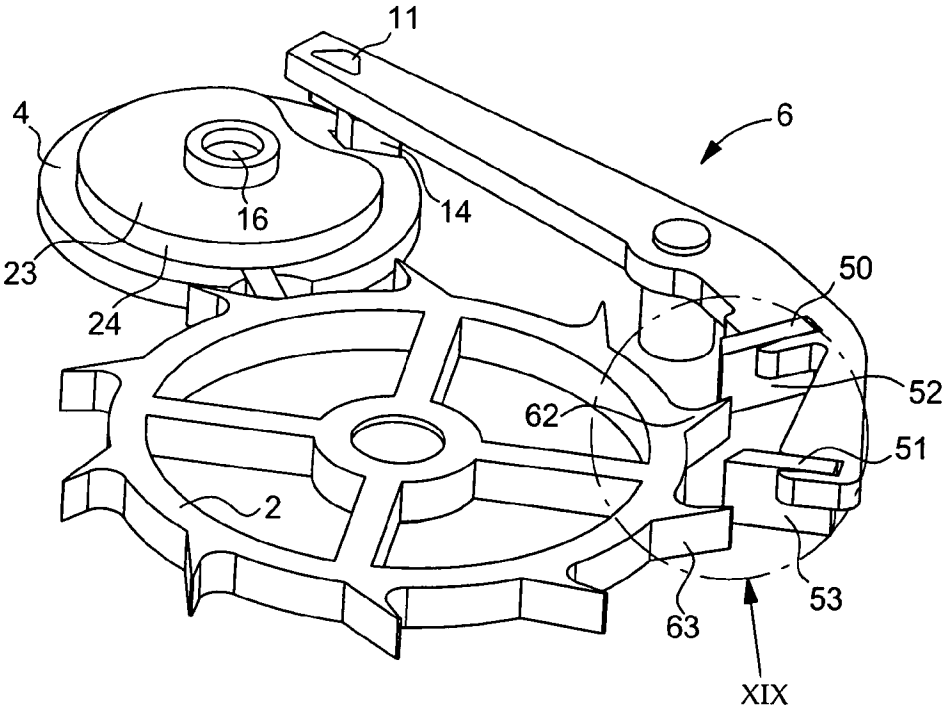
FIG. 18 is a perspective view of the escapement shown in FIG. 17.

FIGS. 17 to 19 illustrate the detent escapement according to a third embodiment. Here the single pallet-stone of the first embodiment has been replaced by first and second locking pallet-stones 50 and 51 respectively cooperating with first and second teeth 62 and 63 of escapement wheel 2. The first and second locking pallet-stones respectively have first and second locking faces 52 and 53, inclined in relation to each other. When the locking device is inserted between the teeth of the escapement wheel, it is the first locking face 52 of first pallet-stone 50 which intercepts the first tooth 62 of wheel 2. This wheel is then completely locked when the second locking face 53 of second pallet-stone 51 enters into contact with second tooth 63 of wheel 2, the inclination of locking face 52 being selected such that it is not possible for tooth 63 to climb along said face 52. However, when first finger 14 drives, via its second side 21, second finger 11, the second tooth 63 climbs over second locking face 53 of second pallet-stone 51 forcing wheel 2 to make a slight backward movement against the drive force exerted thereon. Second tooth 63 returns finally to the first point of contact of second locking face 53 with second tooth 63, when second finger 11 leaves first finger 14.

As regards the rest, the various operating phases remain the same as those explained with reference to FIGS. 4 to 13.

In order for the system to operate properly, it is indispensable for the first and second actuating fingers 14 and 11 to be shaped so as to slide easily on top of each other since, as was seen, finger 14 drives finger 11 by making one complete revolution about the latter. Several shapes can be envisaged to achieve this purpose. The Figures illustrating this description show that the first actuating finger 14 has a parallelepiped cross section and that the second actuating finger has a triangular cross section whose angles are rounded. The invention is of course not limited to these shapes, for example first finger 14 could very well have a triangular cross section with rounded angles, while the second finger 11 has a parallelepiped cross section.

The escapement described hereinbefore appears entirely novel in that that it operates without the use of any elastic member and in that it is economical in terms of the energy consumed by the balance. Because of this, it is perfectly suitable for fitting to small timepieces, for example a wristwatch naturally provided with a balance of small size supplying a small amount of energy. In fact, can the escapement described hereinbefore be called a detent escapement when a detent presupposes an elastic member for actuating it? The present invention retains from the detent escapement the direct action of the escapement wheel on the balance and the single impulse given to the balance for one oscillation of the latter.

It will also be noted in conclusion that the whole of the escapement described is no bulkier than a lever escapement mounted in a wristwatch, if not less, whereas the known detent escapements take up a lot of space, which is why their use is limited to watches of large dimensions.

What is claimed is:

1. A detent escapement for a timepiece including an escapement wheel fitted with teeth, a balance, on the pin of which are fixed a large roller fitted with an impulse pallet-stone and a first actuating finger and a small roller on the circular periphery of which there is made a notch, and a blocking member in the form of a lever hinged on a pin, said blocking member carrying a locking device of the escapement wheel and a second actuating finger, wherein said first and second fingers are shaped such that when the large and small rollers rotate in a first direction, the first finger drives the second finger which moves around a first side of said first finger to release the device locking the escapement wheel, the second finger being then driven by a rising flank of the notch of the small roller to re-engage the locking device in the escapement wheel, and such that when the large and small rollers rotate in a second direction opposite to the first, the first finger drives the second finger which moves around a second side, opposite to the first side, of said first finger to keep the locking device engaged in the escapement wheel.

2. The escapement according to claim 1, wherein the locking device is a locking pallet-stone including a face against which a tooth of the escapement wheel abuts, said face including a first locking face located in the front position of the pallet-stone and a second locking face located in the rear position, the second face being inclined with respect to the first to form a locking line on which the tooth of the wheel rests, the first locking face intercepting the tooth of the wheel when the pallet-stone is inserted between two teeth, said tooth climbing over said second locking face when the first finger drives by its second side the second finger said tooth finally returning to the locking line when the second finger leaves the first finger.

3. The escapement according to claim 1, wherein locking device includes first and second locking pallet-stones arranged one above each other and respectively having first and second locking faces inclined in relation to each other to form a locking line on which the tooth of the wheel rests, the first locking face intercepting the tooth of the wheel when the first pallet-stone is inserted between two teeth, said tooth climbing over the second face of the second pallet-stone when the first finger drives the second finger, via its second side, said tooth finally returning to the locking line when the second finger leaves the first finger.

4. The escapement according to claim 1, wherein the locking device includes first and second locking faces respectively cooperating with first and second teeth of the escapement wheel, said first and second locking pallet-stones respectively having first and second locking faces inclined in relation to each other, the first locking face of the first pallet-stone intercepting the first tooth of the wheel when the locking device is inserted between the teeth of said wheel, the latter being locked when the second locking face of the second pallet-stone enters into contact with the second tooth, said second tooth climbing over said second locking face of said second pallet when said first finger drives said second finger via its second sides said second finger finally returning to the point of contact of the second locking face with the second tooth when the second finger leaves the first finger.

5. The escapement according to claim 1, wherein the blocking member is arranged such that the second finger is immobilised in proximity to, but without touching, the circular periphery of the small roller, when the locking device locks the escapement wheel.

6. The escapement according to claim 1, wherein the first actuating finger has a parallelepiped cross section and wherein the second actuating finger has a triangular cross section whose angles are rounded.

7. The escapement according to claim 6, wherein the first actuating finger has a triangular cross section whose angles are rounded and wherein the second actuating finger has a parallelepiped cross section.

* * * * *